United States Patent [19]

Ostermeyer et al.

[11] Patent Number: 4,699,560

[45] Date of Patent: Oct. 13, 1987

[54] LIFTING APPARATUS SUITABLE FOR EQUIPMENT SUCH AS FORKLIFTS

[75] Inventors: Heinz-Jürgen Ostermeyer; Wolfgang Zschauer, both of Leipzig, German Democratic Rep.

[73] Assignee: VEB Schwermaschinenbaukombinat TAKRAF, Leipzig, German Democratic Rep.

[21] Appl. No.: 801,105

[22] Filed: Nov. 22, 1985

[30] Foreign Application Priority Data

Dec. 7, 1984 [DD] German Democratic Rep. ... 270415

[51] Int. Cl.[4] ..... B66F 9/00

[52] U.S. Cl. ..... 414/696; 414/917

[58] Field of Search ..... 414/696, 680, 917; 187/8.71, 8.72, 9 R

[56] References Cited

U.S. PATENT DOCUMENTS

| | | | |
|---|---|---|---|
| 2,372,220 | 3/1975 | Mork | 414/696 |
| 2,471,364 | 5/1949 | Weber | 414/696 |
| 4,215,971 | 8/1980 | Itey-Bernard | 414/696 |

FOREIGN PATENT DOCUMENTS

| | | |
|---|---|---|
| 156359 | 8/1982 | German Democratic Rep. . |
| 134633 | 1/1985 | German Democratic Rep. . |
| 225854 | 8/1985 | German Democratic Rep. . |

*Primary Examiner*—Robert J. Spar
*Assistant Examiner*—Donald W. Underwood
*Attorney, Agent, or Firm*—Jordan and Hamburg

[57] ABSTRACT

A lifting apparatus arranged on the side of a vehicle frame for vehicles such as various model size forklifts ensures exact vertical movement of the load. The lifting apparatus includes a rocker having inner and outer rockers connected to each other by a common lower rocker bearing and bearing bolt to resist torsion. The outer rocker is directly and operatively connected to a lifting cylinder supported in the vehicle frame. The outer rocker is also operatively connected through a multi-sectional kinematic drive to a rack-and-pinion or drive shaft drive arranged near and operatively connected to the lifting cylinder. An inclination cylinder is operatively connected to pressure bars and is arranged near the lower rocker bearing. The inner and outer rockers are also supported on the front side of a box girder which connects two side portions of the vehicle frame to resist twisting. Visual range is improved and the total mass reduced due to favorable positioning of the center of gravity.

9 Claims, 9 Drawing Figures

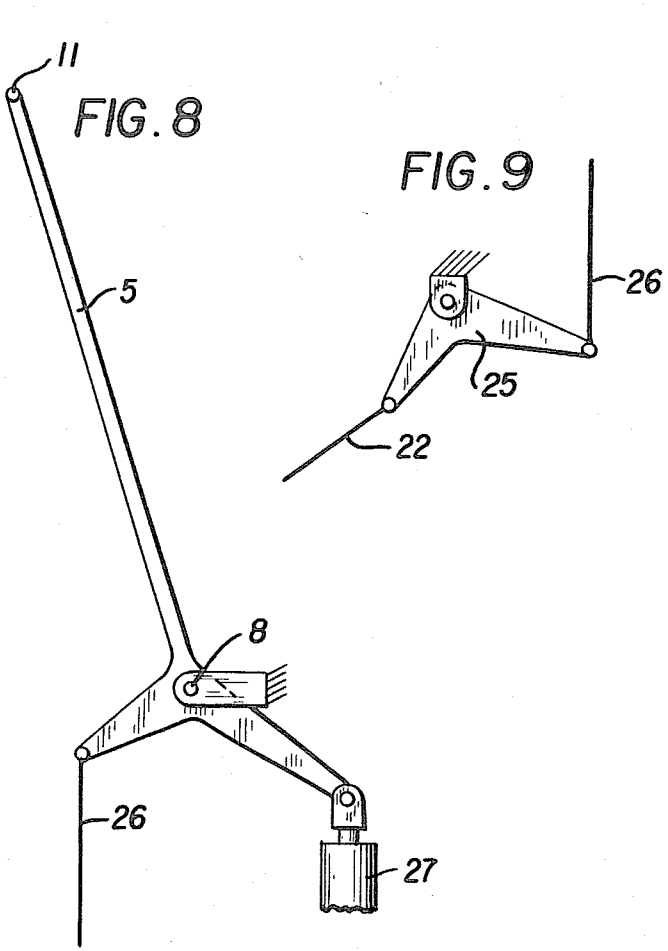
FIG. 9
FIG. 8
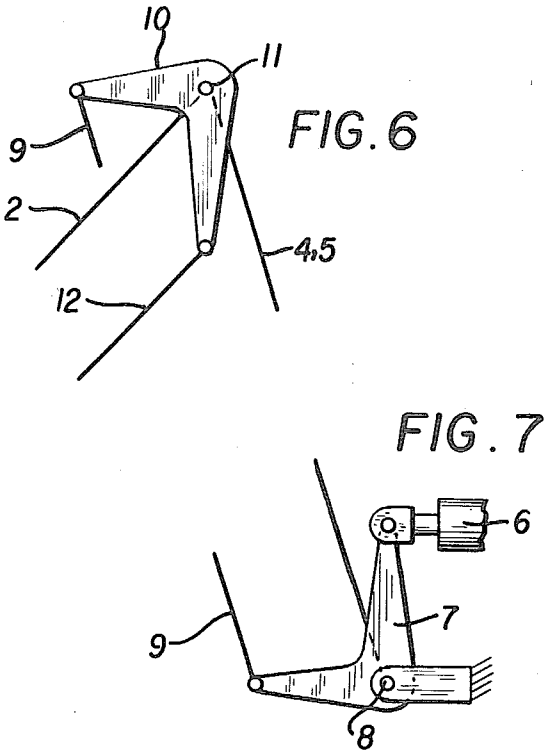
FIG. 7
FIG. 6

LIFTING APPARATUS SUITABLE FOR EQUIPMENT SUCH AS FORKLIFTS

BACKGROUND OF THE INVENTION AND RELATED ART STATEMENT

The invention relates to a lifting apparatus which permits vertical movement of the load to be picked up and which is especially suitable for forklifts of various model sizes.

According to Patent DD-WP No. 134,633 there is known a lifting apparatus, especially suitable for forklifts, whose kinematic main system consists of a four-membered chain drive which is driven by a lifting cylinder, and which includes a frame of a power-propelled vehicle, a control lever, a supporting arm and a rocker. The system which stabilizes the fork support comprises tie rods or pressure bars arranged in parallel and pivotally connected to each other. On the frame of the power-propelled vehicle, eccentrically, on one end in a joint in front of the front-axle, the control lever is pivotally suported; at its other end, in a joint the supporting arm is pivotally supported; at the rear section of the supporting arm in a joint, the rocker is pivotally supported; between these two joints, the piston rod of the lifting cylinder is pivotally supported; and at the front section of the supporting arm in a joint, the fork support pivotally supported.

A system for positionally stabilizing the fork support is arranged eccentrically on one side and consists of tie rods arranged parallel to the supporting arm and to the rocker, the tie rods being operatively connected to each other via a bearing plate.

Furthermore, according to Patent DD-WP No. 156,359, there is known a lifting apparatus whereby a control lever, which is supported in a support detachably mounted on the vehicle frame, is connected to one end of a connecting bar. The connecting bar is supported at its other end on a compensating car which can be conveyed horizontally in the driving direction on the vehicle frame. In the compensating car there are also supported the rocker and an inclination cylinder which is functionally connected with the tie rod via an adjusting lever and the rocker. Because of the great space requirement, the individual displacement points and joints of the lifting apparatus cannot be realized very well and require a high material use.

According to Patent DDR-WP No. 225 854 A3, there has also been proposed a lifting apparatus whereby a support arm provided at one end with a fork support is supported on a support assembly provided on the vehicle frame. The support arm is provided with a joint for the piston rod of the lifting cylinder which, with its lifting cylinder displacement being provided at the lower end, is arranged in a pocket of a side part of the vehicle frame. The other end of the supporting arm is provided with a rocker head with joints for the tie rods and the rocker whereby the rocker connected thereto is operatively connected via the compensating car to a guide rail which is detachably fastened on the side part. The side part with the pocket for the displacement of the lifting cylinder is connected in the front area via a bending-resistant and torsion-resistant upper transversal rod and a detachable tie rod, and in the rear area via a box section and a counterweight having an asymmetrical mass distribution which is resistant to bending and torsion and is connected to the opposite side part.

At the front ends of the two side portions of the vehicle frame, there is a support assembly consisting of two displacement blocks, which are symmetricaly arranged in relation to the longitudinal axis of the vehicle, with face plates which are pivotally connected to the displacement blocks and which can be clapped upwards, and which are operatively connected to the fork support.

OBJECT OF THE INVENTION

Summary of the Invention

It is an object of the lifting apparatus of the present invention, in particular for forklifts, to attain a mass reduction by utilization of simple parts while improving the visual range for the driver.

The invention is based on the objective of providing a lifting apparatus, especially for forklifts, having simple joint connections, which ensures without rocking paths or compensating car an exact vertical guidance of the load and makes possible a greater displacement of the total center of gravity towards the rear, so that a reduction of the counterweight is achieved. According to the invention, the object is attained in that the rocker comprises an inner rocker and an outer rocker which are connected to each other to be resistant to torsion by a shared lower rocker bearing via a bearing bolt. The outer rocker is directly operatively connected to a differential cylinder supported in the vehicle frame and via a multi-sectional kinematic drive to a rack-and-pinion drive or drive shaft drive in the vicinity of the lifting cylinder. An inclination cylinder, which is operatively connected to the pressure bars, is arranged in the vicinity of the lower rocker bearing. The differential cylinder and the multi-sectional kinematic drive are directly functionally connected via the bearing bolts to the rockers. The inner rocker and the outer rocker are supported at the front side of a box girder which connects the two side portions of the vehicle frame so as to render the two side portions resistant to twisting.

The rack-and-pinion drive or drive shaft drive consists of an upper push rod supported together with the piston rod of the lifting cylinder on a joint pin in the supporting arm, a lower push rod supported together with the lifting cylinder on a joint pin at the side in the vehicle frame, a movable guide with a pinion supported therein which engages both push rods, and a connecting element operatively connected via a joint, on the one hand, to a rocker supported in the vehicle frame and, on the other hand, via a coupler to a toggle-lever which is also supported in the vehicle frame, and via a further coupler to the outer rocker or both rockers and to the differential cylinder.

Furthermore, the side part of the vehicle frame which receives the lifting apparatus is provided in the longitudinal direction with a separating wall. In the inner space there are arranged three chambers. The front chamber and the rear chamber are connected to each other by an intake as well as a ventilation duct and are configured as a fuel tank, while the middle chamber is configured as a lifting cylinder bearing. In the outer space the multi-sectional kinematic drive with the rack-and-pinion drive or drive shaft drive is arranged and covered by a removable outer wall. On the vehicle frame, there is provided a guide which braces the supporting arm on both sides in the lower lifting area. The exact vertical guidance of the load is possible because simultaneously with the movement of the supporting arm by the lifting cylinder, via the rack-and-pinion drive or the drive shaft drive and the serially arranged multi-sectional kinematic drive, as well as via the differential cylinder, the position of the two rockers at which the supporting arm is pivoting is determined. While the drives ensure the exact course of movement, the differential cylinder produces the required force for the movement of the rockers. For this purpose, the differential cylinder is under the same oil pressure as the lifting cylinder in that it is directly connected thereto. When the lifting movement is turned off, the differential cylinder is hydraulically blocked, thereby stabilizing the rockers in their positions.

BRIEF DESCRIPTION OF THE DRAWINGS

The invention will be better understood by reference to the accompanying drawings, in which

FIG. 6 is an enlarged schematic view of one portion of the kinematic system shown in FIG. 1;

FIG. 7 is an enlarged schematic view of a second portion of the kinematic system shown in FIG. 1;

FIG. 8 is an enlarged schematic view of a third portion of the kinematic system shown in FIG. 1; and FIG. 9 is an enlarged schematic view of a fourth portion of the kinematic system shown in FIG. 1.

DETAILED DESCRIPTION OF THE PREFERRED EMBODIMENT

Figure 1:
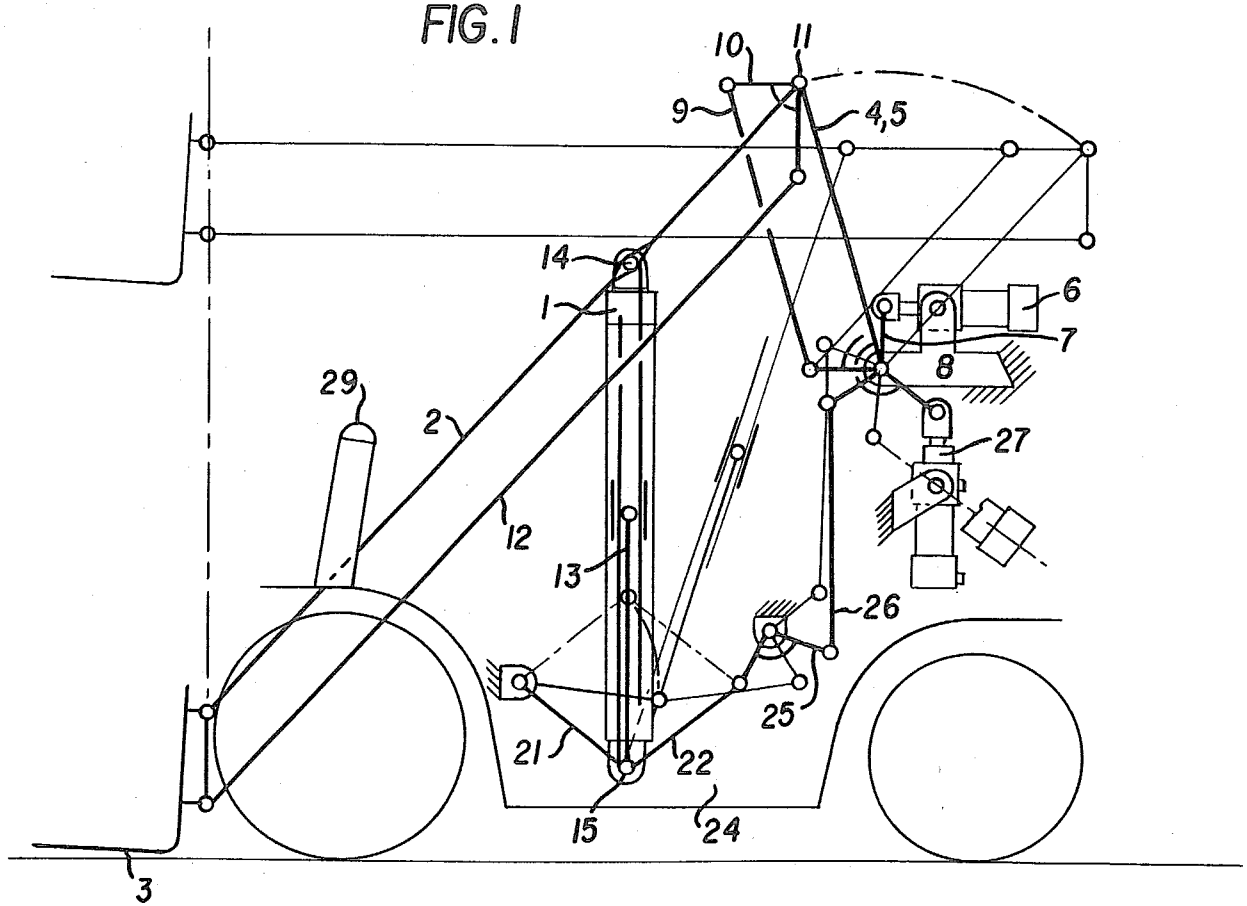
FIG. 1 is a schematic cross-sectional view of the kinematic system of the present invention.
Figure 2:
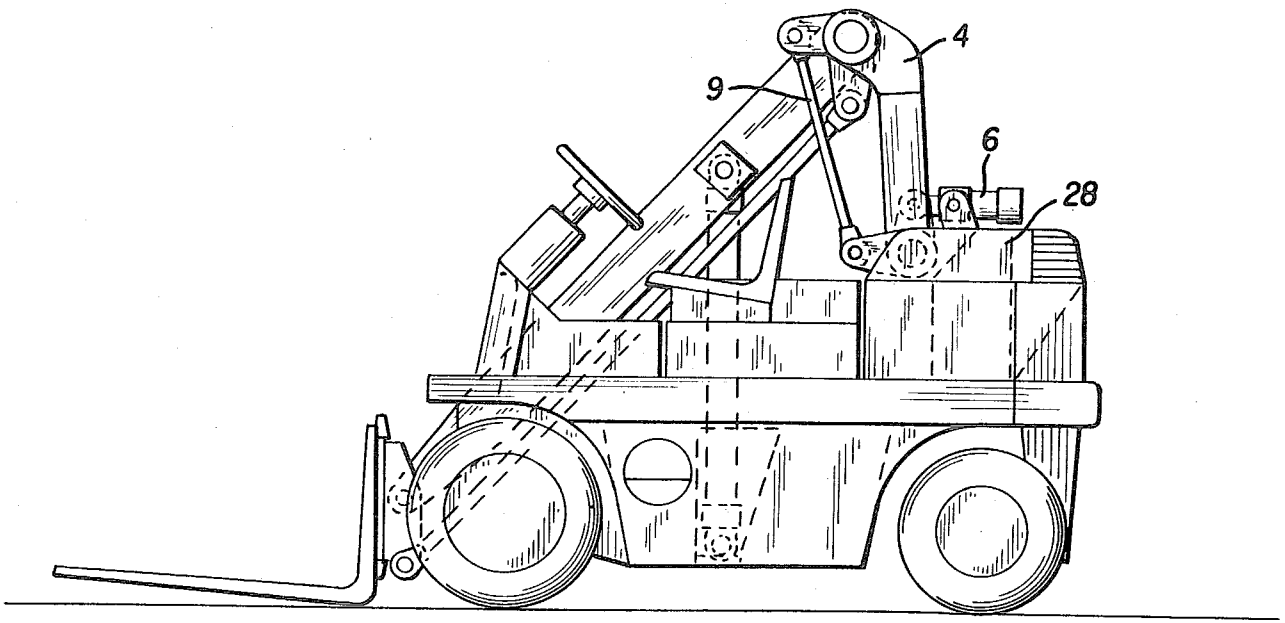
FIG. 2 is a side view of a forklift embodying the kinematic system of the present invention.
Figure 4:
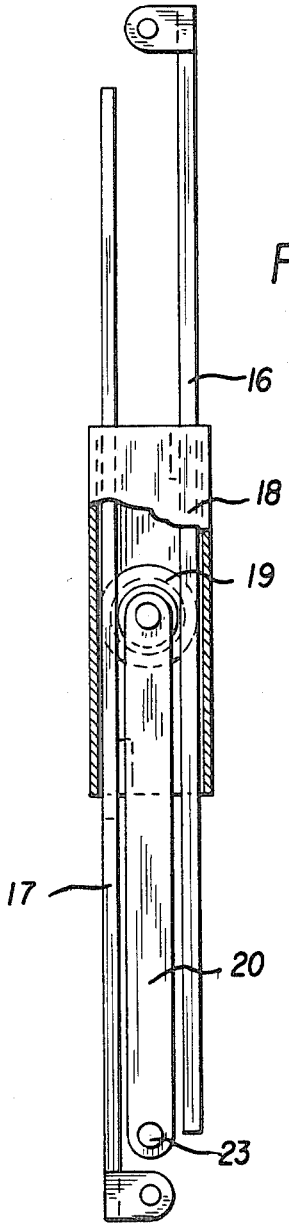
FIG. 4 is a sectional view, partially cut away, showing the drive shaft drive of the kinematic system shown in FIG. 1.

As shown in FIG. 1, when hydraulic fluid is applied to lifting cylinder 1, supporting arm 2, which is arranged off-center on one side, is lifted, along with fork support 3 having fork prongs located at the front end of the supporting arm 2. The maintenance of the inclination of the fork support over the entire lift or change thereof is effected via the inclination cylinder 6 supported in the rear area of the lifting apparatus between rocker 4 and rocker 5, the inclination cylinder 6 operatively connected to two toggle-levers 7 supported on the bearing and bearing bolt 8 the bearing and, bearing bolt 8 torsion-resistantly connecting the two rockers 4 and 5, the two pressure bars 9, two toggle-levers 10 between an upper rocker bearing 11, pressure bar 12 located centrally between but below the supporting arm 2, and the fork support 3. Positioning of the upper rocker bearing 11, by which the supporting arm 2 is pivotally regulated in its arcuate path and which is required in order to attain a vertical lifting movement, is controlled by a drive shaft drive indicated generally at 13, which is arranged next to the lifting cylinder 1 on upper and lower joint pins 14, 15, and depends on the piston lift of the hydraulic cylinder 1. As shown in FIG. 4, pinion 19, which is supported in the movable guide 18, is thereby moved in the direction of the lift of the piston at one half of the speed of the piston. The pinion 19 is arranged between upper push rod 16, which is pivotally fastened to the supporting arm 2, and lower push rod 17, which is pivotally arranged on the right outer frame.

Accordingly, rocker 21 and coupling 22, both of which are connected to lower joint 23 of connecting element 20, are moved via connecting element 20 supported on pinion 19. Additionally, outer rocker 5 is moved via toggle lever 25 supported on vehicle frame 24 and coupling 26. The outer rocker 5 is provided in the area of its lower support on the bearing bolt 8 with two additional joints, one of which is operatively connected to the coupling 26 and the other to differential cylinder 27.

The differential cylinder 27 cancels the resulting forces introduced by lifting cylinder 1 on the upper rocker bearing 11 in the circular movement direction and prevents these forces from being applied via the kinematic movement, thereby releasing them. The kinematic movement only transmits frictional forces, and differential forces which remain at insufficient compensation. The large piston surface of the differential cylinder 27 with differential pistons is constantly under the same oil pressure as the lifting cylinder 1, because it is directly connected to it. Therefore, besides an approximately equally great piston lifting force, an even lifting speed takes place over the entire lift.

The differential piston space of the differential cylinder 27 is directly connected to the oil tank and is always filled with hydraulic oil. When the lifting movement is turned off, both cylinder spaces of the differential cylinder 27 are closed by passage valves so that no oil can flow in or flow out. Neither of rockers 4, 5 can change position because the outer rocker 5 is in its lower rocker bearing and is connected to the inner rocker by means of the bearing bolt 8 so as to render rockers 4,5 resistant to torsion. The rockers 4, 5 are jointly supported on a U-shaped box girder 28 which connects the two side portions of the vehicle frame 24 so as to render them resistant to twisting. Box girder 28 forms the upper limit of the rear portion of the stacker and is provided on one side to support inclination cylinder 6, which is arranged above the box girder 28, behind the lower rocker bearing 8 and centrally under the supporting arm 2.

Guide 29 arranged in the front area of the vehicle frame 24 absorbs in the lower lifting area the lateral forces which act upon the supporting arm 2, in particular during movement of arm 2, and conducts them directly into the vehicle frame 24.

Figure 5:
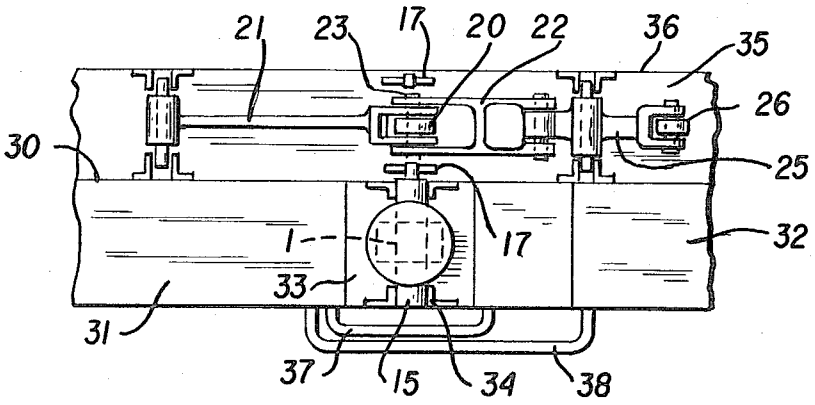
FIG. 5 is a top cross-sectional view of the vehicle frame of the forklift shown in FIG. 2.

As shown in FIG. 5, a partition wall 30 separates the vehicle frame into an outer space 35 and an inner space comprising a front chamber 31, a rear chamber 32 and a central chamber 33. Feed pipe 37 connects front chamber 31 and rear chamber 32, both of which comprise a fuel tank, which also includes a vent pipe 38.

In the outer space 35, illustrated in FIG. 5, parts of the multi-sectional kinematic gear transmission are shown, for example, mountings for the rocker arm 21 and the bent lever or bell crank 25, which are provided once at the partition 30 and again at a removable outer wall 36, the connection of rocker arm 21 through rocker arm 22 to the bent lever or bell crank 25, as well as the coupling of the lower thrust rod 17 of the pin wheel gear 13 in the area of the extended hinge pin 15 mounted on lifting cylinder mounting 34, which is located in the central chamber 33. The rocker arm 21, as well as the coupler 22 are supported at the hinge point 23 of the connecting link 20 (see FIG. 4).

The various bent levers or bell cranks and the respective parts connected to them can be seen in FIGS. 6 to 9.

Figure 3:
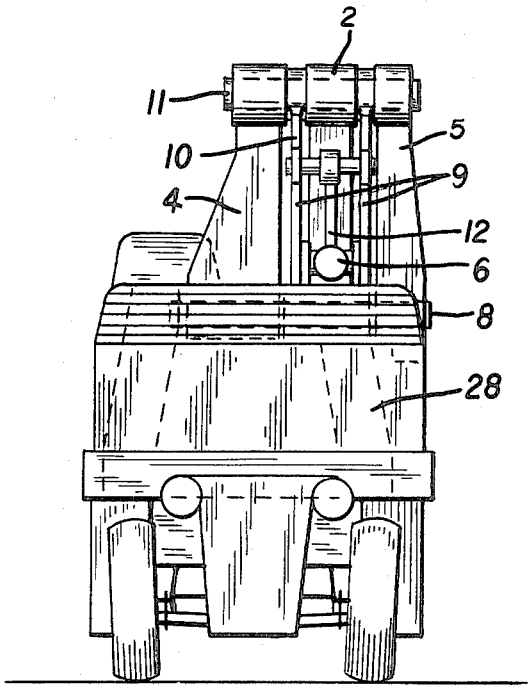
FIG. 3 is a rear view of the forklift shown in FIG. 2.

FIG. 6 shows the bent lever or bell crank 10, which is disposed in duplicate and, moreover, on either side of the supporting arm 2 about the link bracket 11 (see FIG. 3). Each of the bent levers or bell cranks 10 is engaged by one of the two thrust rods 9, which are connected at their other end with one of the two bent levers or bell cranks 7 (see FIG. 7). The two thrust rods 10 are jointly engaged moreover by the thrust rod 12 (see FIG. 3).

FIG. 7 shows the bent lever or bell crank 7, which is also disposed in duplicate. Both bent levers or bell cranks 7 are supported laterally in the vehicle frame 24 and moreover on the mounting pin 8, which forms the torsionally rigid connection between the two rocker arms 4, 5. The two bent levers or bell cranks 7 are each engaged, on the one hand, by the tilt cylinder 6, which is also supported in the vehicle frame 24 and, on the other hand, by one of the two thrust rods 9, as already described.

FIG. 8 illustrates the construction of the outer rocker arm 5 which, as already described, is connected in torsionally rigid fashion over mounting pin 8 with the inner rocker arm 4 (see FIG. 3). The outer rocker arm 5 is engaged, on the one hand, by the compensating cylinder 27, which is also supported in the vehicle frame 24 and, on the other hand, by the coupler 26. It can be seen from FIG. 9 that the other end of the coupler 26 is articulated with the bent lever or bell crank 25, which is also supported in the vehicle frame 24. This bent lever or bell crank 25 moreover engages the coupler 22, the other end of which in joint 23 is functionally connected with rocker arm 21, which is supported in the vehicle frame 23, and with the connecting link 20.

It is evident from FIGS. 6 and 7 that, when the tilt or inclination cylinder 6 is activated, this tilt cylinder, through the bent levers or bell cranks 7, the thrust rods 9, the bent levers or bell cranks 10 and the thrust rod 12, changes the position of the fork carrier 3, since the bent levers or bell cranks 7 and 10 are constucted such that the thrust rods 9 with the rocker arm 4, 5 and the thrust rod 12 with the supporting arm 2 in each case form a parellelogram. The advantages of this lifting apparatus consist in improvement of the visual range because of the elimination of the frontal sidewise bearing frame, the elimination of the compensating car for exact vertical guidance and a reduction and simplification of the parts, combined with a displacement of the center of gravity towards the rear, which leads to a reduction of the total mass of the apparatus.

What I claim is:

1. A lifting apparatus especially suitable for forklifts comprising a vehicle frame;

a lifting cylinder arranged eccentrically on one side of the vehicle frame and having a first end and a second end;

a kinematic main system including a supporting arm connected to the first end and driven by the lifting cylinder;

a fork support connected to a front end of the supporting arm;

a rocker comprising an inner rocker and an outer rocker supported by the vehicle frame pivotally connected to a rear end of the supporting arm;

a first pair of pressure bars for stabilizing the fork support arranged eccentrically on said one side of the vehicle frame and pivotally connected parallel to the rocker;

a second pressure bar for stabilizing the fork support arranged eccentrically on said one side of the vehicle frame and pivotally connected parallel to the supporting arm;

a lower rocker bearing and bearing bolt for connecting the inner rocker and outer rocker to each other for resisting torsion;

a differential cylinder supported in the vehicle frame and directly connected to the outer rocker;

means operatively connected to the lifting cylinder for driving the lifting cylinder;

a multi-sectional kinematic drive connecting the outer rocker to the means for driving the lifting cylinder at the second end of the lifting cylinder; and an inclination cylinder operatively connected to the pressure bars through the lower rocker bearing.

2. The lifting apparatus according to claim 1, wherein the differential cylinder and multi-sectional kinematic drive are operatively connected to the inner and outer rockers through the bearing bolt and lower rocker bearing.

3. The lifting apparatus according to claim 1, wherein a box girder connects two side portions of the vehicle frame to prevent twisting and the inner and outer rockers are supported on a front side of the box girder.

4. The lifting apparatus according to claim 1, wherein the means for driving the lifting cylinder comprises an upper push rod supported together with a piston rod of the lifting cylinder on a first joint pin in the supporting arm, a lower push rod supported together with the lifting cylinder on a second joint pin on a side of the vehicle frame, a pinion supported within a movable guide for engaging the upper and lower push rods, and a connecting element operatively connected via a joint to a second rocker supported in the vehicle frame and also operatively connected to the differential cylinder through a coupler, a toggle-lever supported in the vehicle frame, a second toggle-lever and at least the outer of the inner and outer rockers.

5. The lifting apparatus according to claim 1, wherein the vehicle frame includes a separation wall dividing the vehicle frame into an inner space and an outer space, the inner space comprising a front chamber, a middle chamber and a rear chamber, the front and rear chambers each having an intake duct and a ventilation duct and comprising a fuel tank, the middle chamber comprising a lifting cylinder bearing, the outer space being covered by a removable outside wall and having arranged therein the multi-sectional kinematic drive and the means for driving the lifting cylinder.

6. The lifting apparatus according to claim 1, wherein a guide is arranged on the vehicle frame for bracing the supporting arm on both sides in a lower lifting area.

7. The lifting apparatus according to claim 1, wherein the means for driving the lifting cylinder comprises a rack-and-pinion drive.

8. The lifting apparatus according to claim 1, wherein the means for driving the lifting cylinder comprises a drive shaft drive.

9. The lifting apparatus according to claim 1, further comprising an upper rocker bearing, a first pair of toggle levers connecting the inclination cylinder to the first pair of pressure bars and connecting the differential cylinder to the outer rocker through the lower rocker bearing and a second pair of toggle levers connecting the rocker to the supporting arm and connecting the first pair of pressure bars to the second pressure bar through the upper rocker bearing, whereby activation of the inclination cylinder moves the fork support through the first pair of toggle levers, the first pair of pressure bars, the second pair of toggle levers and the second pressure arm while the first pair of pressure bars are kept parallel to the rocker and the second pressure bar is kept parallel to the supporting arm.

* * * * *